US005407405A

United States Patent [19]

Oren

[11] Patent Number: 5,407,405

[45] Date of Patent: Apr. 18, 1995

[54] GRIP HANDLE FOR SPORT AND PHYSICAL EXERCISE IMPLEMENTS

[75] Inventor: Shaul Oren, 6/7 Halia Street, Kiryat Tivon 36000, Israel

[73] Assignees: Shaul Oren; Avraham Levi; Oded Singer, all of Kiryat Tiyon, Israel

[21] Appl. No.: 22,044

[22] Filed: Feb. 24, 1993

Related U.S. Application Data

[63] Continuation-in-part of Ser. No. 804,323, Dec. 10, 1991, abandoned.

[51] Int. Cl.[6] ..... A63B 21/072; A63B 23/16

[52] U.S. Cl. ..... 482/50; 482/46; 482/106; 482/139

[58] Field of Search ..... 482/44, 45, 46, 50, 482/106, 108, 139

[56] References Cited

U.S. PATENT DOCUMENTS

| | | |
|---|---|---|
| Re. 33, 218 | 5/1990 | Twardosz . |
| 3,384,370 | 5/1968 | Bailey et al. . |
| 4,461,473 | 7/1984 | Cole . |
| 4,629,184 | 12/1986 | Selkee . |
| 4,690,400 | 9/1987 | Metz . |
| 4,822,035 | 4/1989 | Jennings et al. . |
| 5,024,434 | 6/1991 | Smith . |
| 5,080,349 | 1/1992 | Vittone . |

*Primary Examiner*—Richard J. Apley
*Assistant Examiner*—Lynne A. Reichard
*Attorney, Agent, or Firm*—Jacobson, Price, Holman & Stern

[57] ABSTRACT

There is proposed the provision of a grip handle for sport and physical exercise implements which enables a person to maintain a full freedom of manual movement at the time of firmly grasping and holding to the handle grips of the equipment provided for sportive activity and physical exercise. The grip handle incorporates a hoop member positioned in the bend of a bow or similarly shaped element. The hoop is revolvable in the bow shaped element and has a diametrically extending grip rod which is freely movable in the plane of the hoop. Two of the bow shaped elements are connected to known exercise apparatus so that while working on the respective apparatus, it is possible for the wrists to work and move freely.

4 Claims, 6 Drawing Sheets

GRIP HANDLE FOR SPORT AND PHYSICAL EXERCISE IMPLEMENTS

This is a continuation-in-part of application Ser. No. 07/804,323, filed Dec. 10, 1991, now abandoned.

FIELD AND BACKGROUND OF THE INVENTION

The present invention relates to a grip handle for certain sport implements, exercise apparatus and sport machines. More particularly the invention concerns such a grip handle which is part of and is connected to implements or certain machines for the performance of athletic exercises in the course of which the exercising person takes hold and firmly grips with one or both hands a part, such as a hoop or ring, which is in a suspended manner hanging from fixed element, such as the ceiling of a room or a beam or girder extending horizontally at an elevated level. In the performance of such athletics or when using like implements or apparatus, the exercising person, while gripping the said hoop or ring or other parts of the respective apparatus, has to perform a variety of movements with her or his hands involving turning the hand about the joint between the hand proper and the lowermost part of the arm.

There are known a number of patents which relate to similar apparatus.

U.S. Pat. No. 3,384,370 relates to a weight lifting apparatus (Barbells) in which a pair of rotatably mounted handle means are incorporated in the rod means of the apparatus, the two handles each rotating within a ring fixedly attached to said rod.

U.S. Pat. No. 4,461,473 relates to a weight lifting apparatus having a central part which comprises a rectangular frame in which a pair of rings are journalled for rotation. Two handles are fixedly secured in the pair of rings.

U.S. Pat. No. 4,629,184 relates to an exercise apparatus where the handles are fixedly mounted within a ring rotatably mounted within a U-shaped member which is rotatably mounted to the apparatus.

U.S. Pat. No. 4,690,400 relates to Barbells provided with a pair of rings fixedly connected to the Barbells' bar. Two handles are rotatably within the rings.

U.S. Pat. Re33218 relates to a weight lifting bar provided with handles which may selectively rotate within a ring comprising part of the bar.

U.S. Pat. No. 4,822,035 relates to an adjustable barbell bar. Rotating handles are mounted within a ring fixedly held within a rectangular frame.

U.S. Pat. No. 5,024,434 relates to an excise device incorporating a weight lifting bar provided with a pair of rings provided as a part of said bar. Handles provided within the rings are rotatably mounted.

U.S. Pat. No. 5,080,349 relates to a barbell rod from which two rings provided with fixed handles are rotatably mounted.

In all the above arrangements either the ring is rotatably mounted or the handle is rotatably mounted within the ring, which enables the user to exercise his wrist only in one plane with the exception of the arrangement decreded in -'184 where the ring is mounted within two rotatably members thus enabling better exercise of the wrist.

Contrary to all the above described apparatus and arrangments the assembly according to the invention enables the rotation of the handle in two planes thus the wrist is free to move in any required direction and angle.

The assembly according to the invention simulates a universal movement or gyroscope.

OBJECTS OF THE INVENTION

It is the main object of the invention to provide a grip assembly which an exercising person can firmly grip and hold while at the same time allowing a full degree of freedom of hand movement, as may be required by a specific exercise, or which can be added to a specific exercise.

The main object is obtainable by the use of a hand grip according to the invention. The hand grip comprises a closed circular hoop member held within the confines of a bow or similarly shaped element and rotatable about its diametrical axis, a diametrical grip handle extending within the said hoop member in such a manner that it is freely movable in the plane of the hoop.

According to a further feature of the invention, the diametrical handle is held at both of its ends in a circumferential groove at the inner circumference of the hoop member.

According to an alternative embodiment the two ends of the diametrically extending handle are formed bifurcatedly and straddle with the so formed ends the body of the hoop shaped number.

BRIEF DESCRIPTION OF DRAWINGS

These and further features of the invention will become clear from the following detailed description which has reference to the accompanying drawings, in which.

DESCRIPTION OF PREFERRED EMBODIMENT

Figure 1:
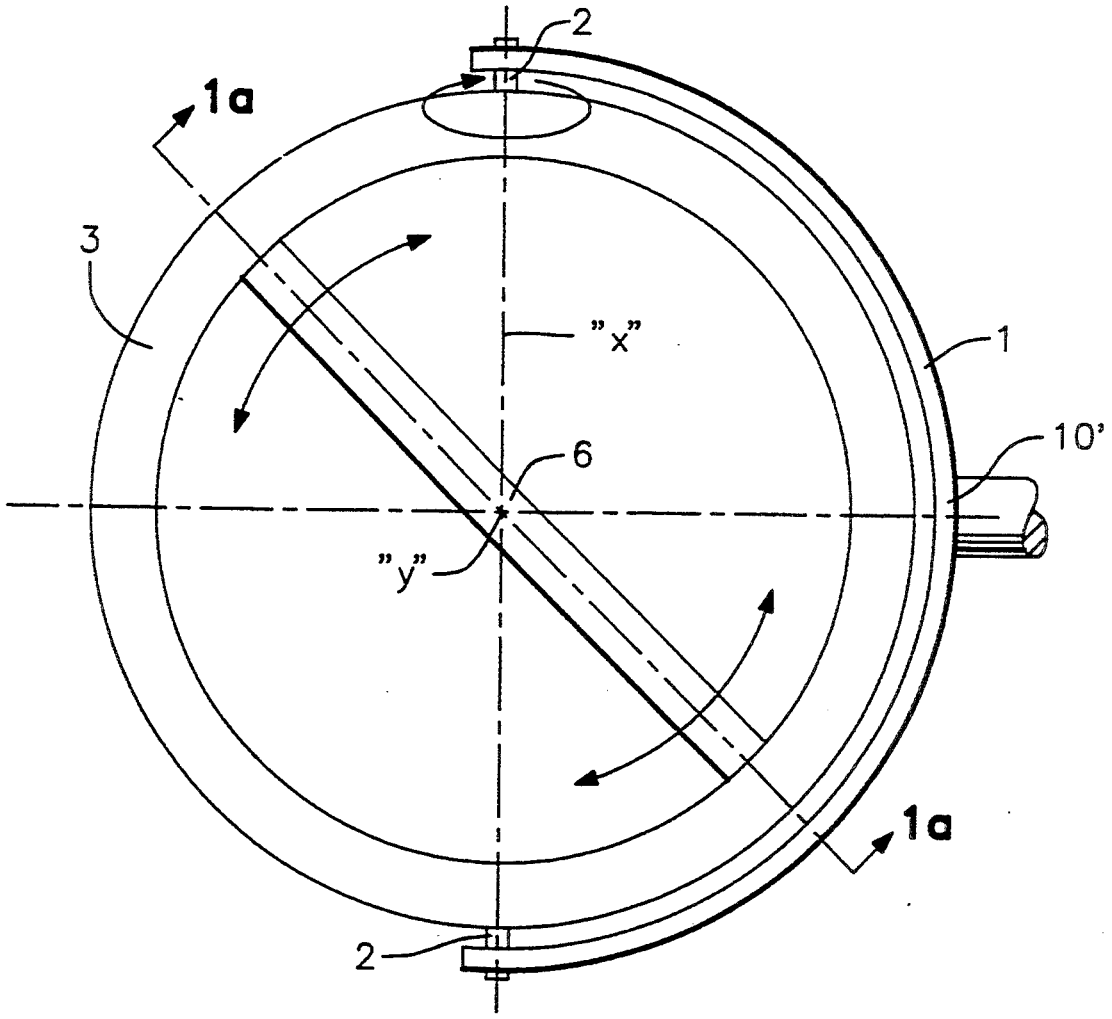
FIG. 1 shows the new grip handle assembly in an elevational view.

Turning first to FIG. 1, there is shown the new grip assembly comprising an outer bow shaped member 1 within the confines of which is located a circular hoop 3. The bow member 1 supports the hoop 3 therefrom for rotation of the hoop 3 within the bow.

The bow member 1 has at both of its end pins 2 which are directed towards the center of the respective hoop 3, and which enable the rotation of hoop 3 about axis "X".

Figure 1A:
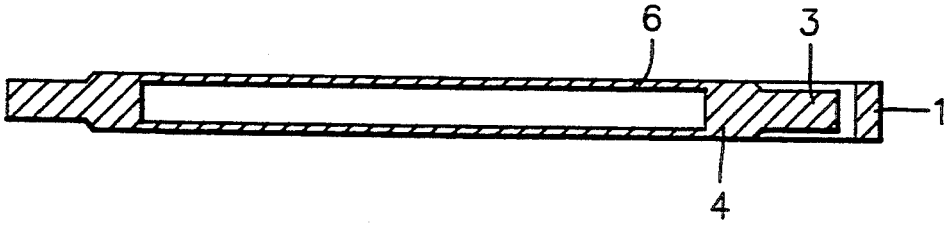
FIG. 1*a* is a fractional, sectional view taken substantially upon a plane designated by the section line 1*a*—1*a* of FIG. 1.
Figure 1B:
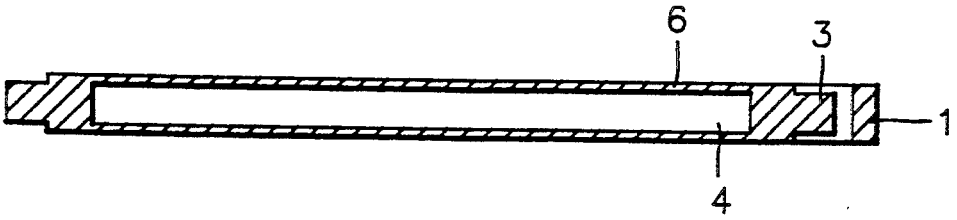
FIG. 1*b* is a sectional view similar to FIG. 1*a*, but illustrating a modified form.

Within hoop 3 extends diametrically a handle grip or rod 6 which is interconnected with hoop 3 as shown in either FIG. 1*a* or 1*b;* as seen in FIG. 1*a* the ends of rod 6 have a slightly curved flange 6' and a tooth 6'' which latter enters a circumferential groove 4 at the inner circumference of hoop 3. The second possibility of interconnection of rod 6 with the hoop 3 is seen in FIG. 1*b*. The ends of rod 6 are bifurcated and form a fork 6*a* which with it curved tines embraces the profile of hoop 3. In both cases the rod 6 can be moved within hoop 3, always remaining in diametrical relation with the hoop.

Figure 2:
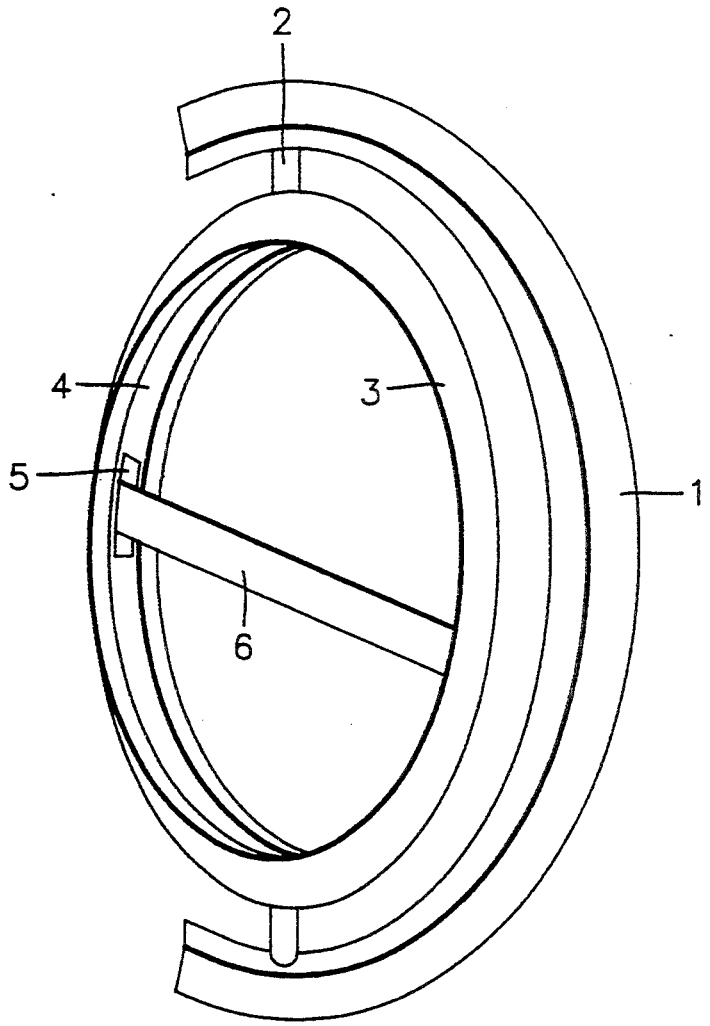
FIG. 2 is a partly perspective view of new grip assembly, seen from a different angle.

As can be gathered by a glance at FIG. 2, the hoop 3 can revolve within the bow 1 about axis "X", (see FIG.

1) extending between the two pins 2. Further handle 6 can freely move, within hoop 3, about an imaginary axis "Y" (see FIG. 1) though always maintaining its diametrical position in relation thereto.

The bow shaped member 1 may be connect at 10' to an exercise apparatus or similar implements.

FIG. 2 illustrates the flexibility of the assembly and the degree of freedom it enables the user.

Some practical examples of use of the new grip assembly are shown in FIGS. 3–6.

Figure 3:
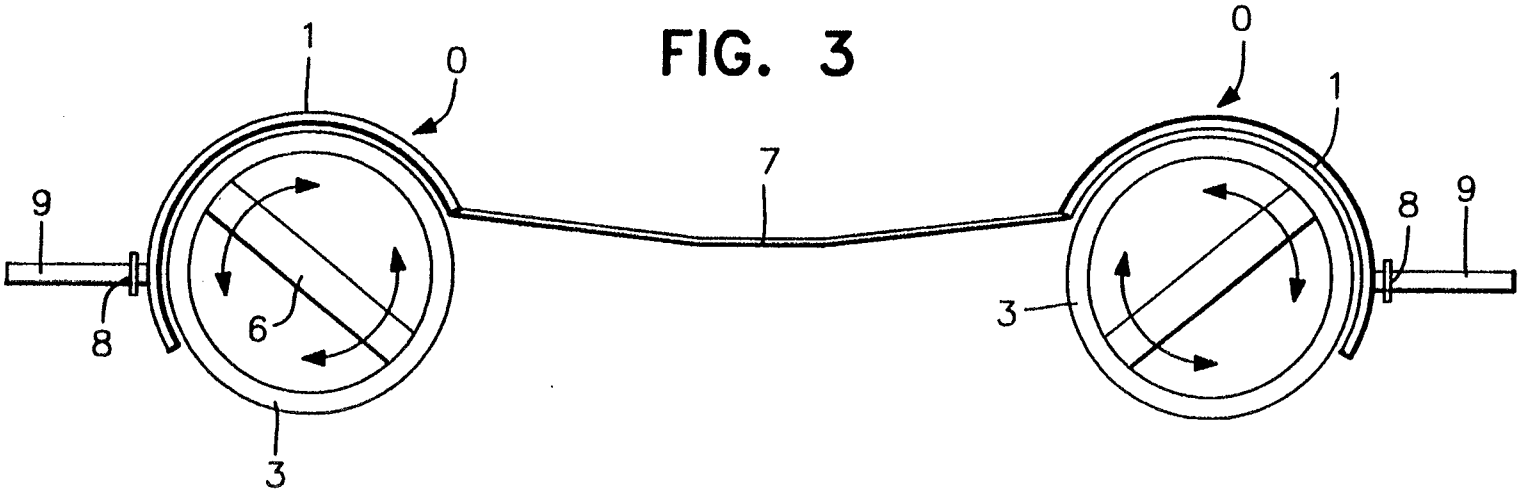
FIGS. 3–6*a* are schematical views of the new grip assembly for use with different implements.
Figure 3A:
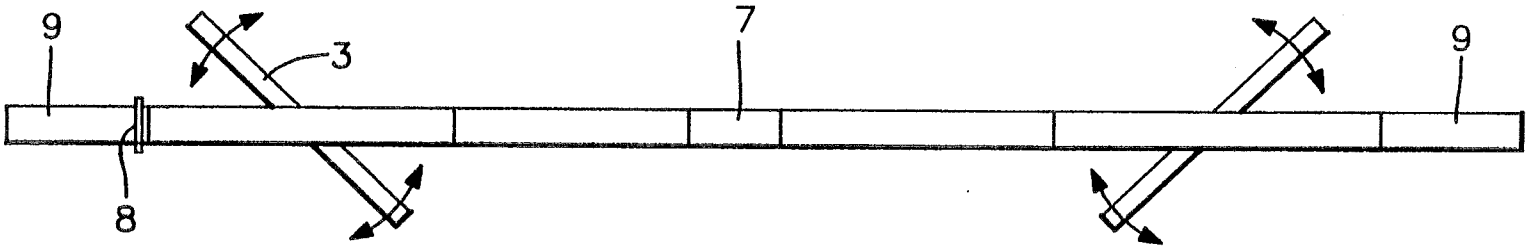

The example of FIGS. 3 and 3*a* being a frontal and elevational views. The arrangement comprises two assemblies 0 which each includes the parts shown in and described in connection with FIG. 1. The two assemblies 0 are connected with one another by a rigid connector 7. From each of the bow members 1 in each of assembly 0 extends a bar 9 adapted to receive thereon standard detachable weights, a collar 8 is provided for securing said weights. It is point out that the whole arrangement could be connected to a cable (now shown) at the middle of connector 7. Such cable may be led over a pulley located above and is weighted at its free end by a load of whatever kind, preventing it from slipping away from the pulley over which it is led. The number of weights on bars 9 is prevented from knocking against the bow of the assembly by the collar 8. The exerciser grips the rods 6 which extend in the hoops 3 and performs prescribed exercising movements with both arms, activating muscle force against the bias of weights on bars 9.

It is quite obvious that the whole arrangement could be used without the cable.

Figure 4:
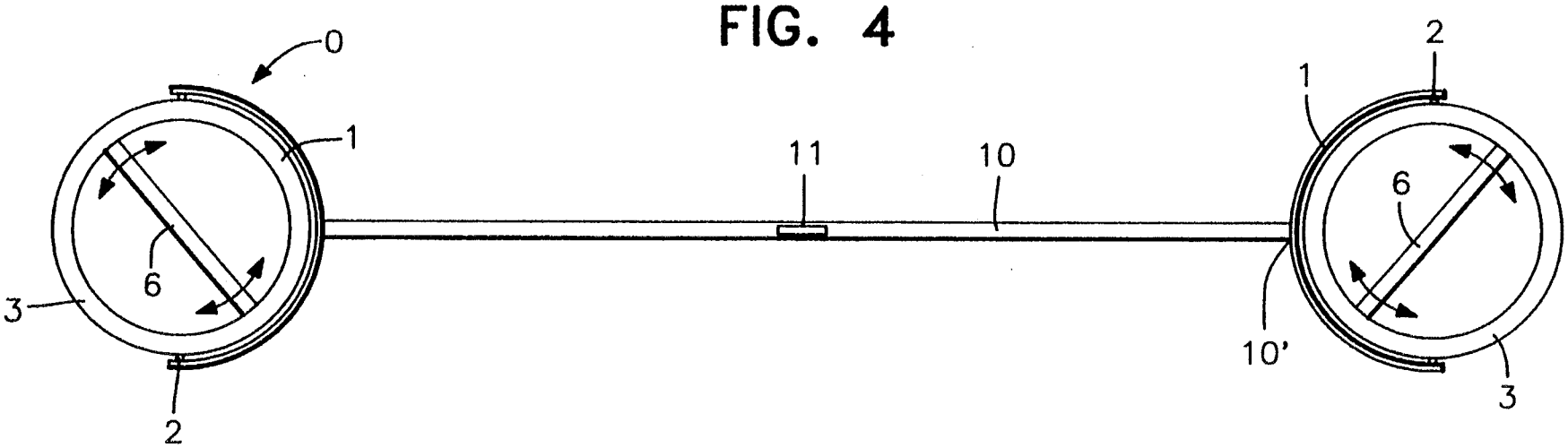
Figure 4A:
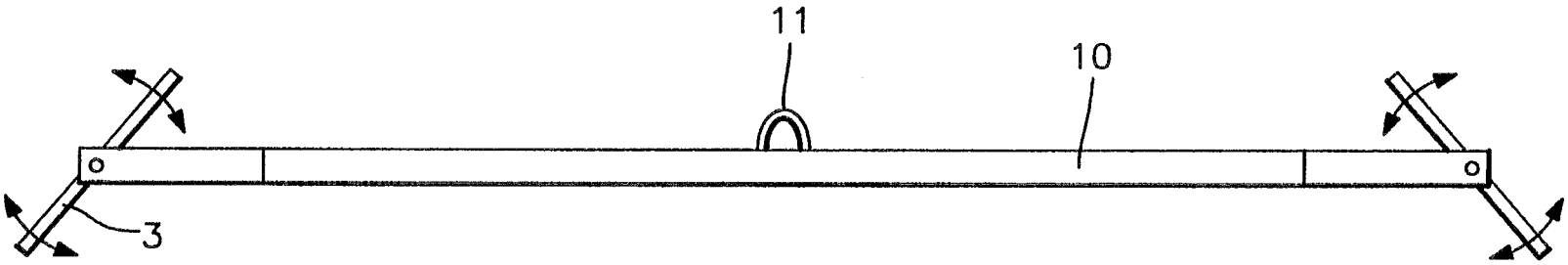

According to FIGS. 4*a* and 4*b*, being frontal and elevational views, the two assemblies 0 are suspended from a cable or chain attached to a connecting bar 10 at a point 11. Here again the exerciser grips the rods extending within the hoops 3 and performs the prescribed movements, possibly hanging from the grip assemblies 0.

Figure 5:
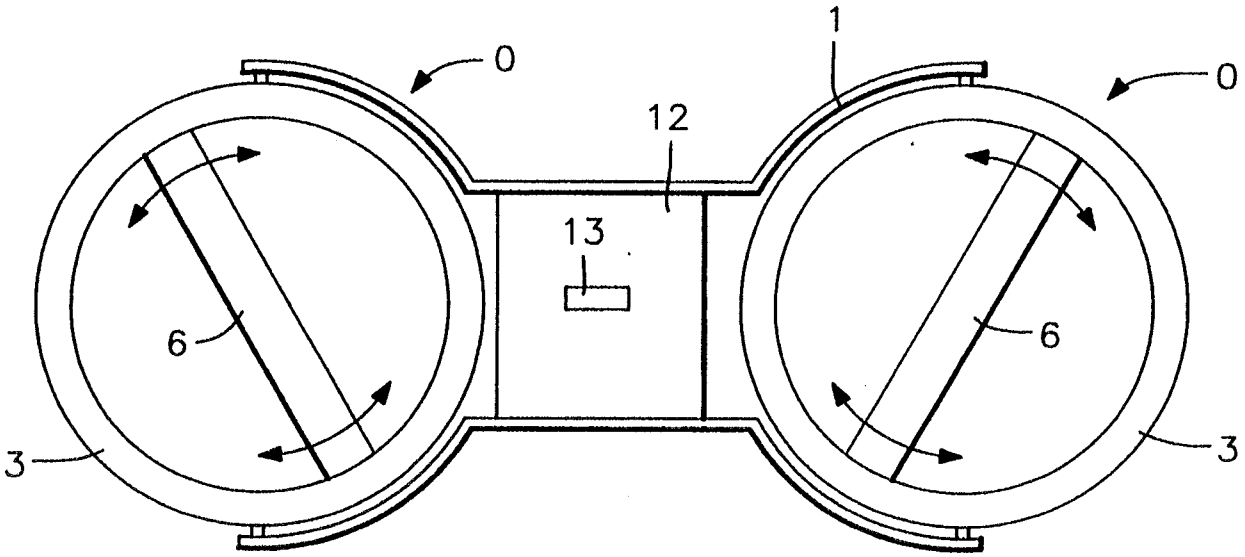
Figure 5A:
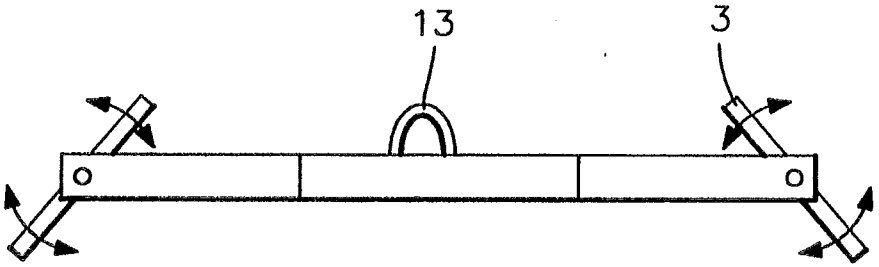

In the example of FIGS. 4 and 5*a* being front and elevational views, the grip handle assemblies are also designed by 0 and are interconnected by plate 12 which may be in turn attached at 13 to a device or for physical exercising. The exercising person (now shown) may grip the two bars of the assemblies 0 with both hands and perform the prescribed movements.

Figure 6:
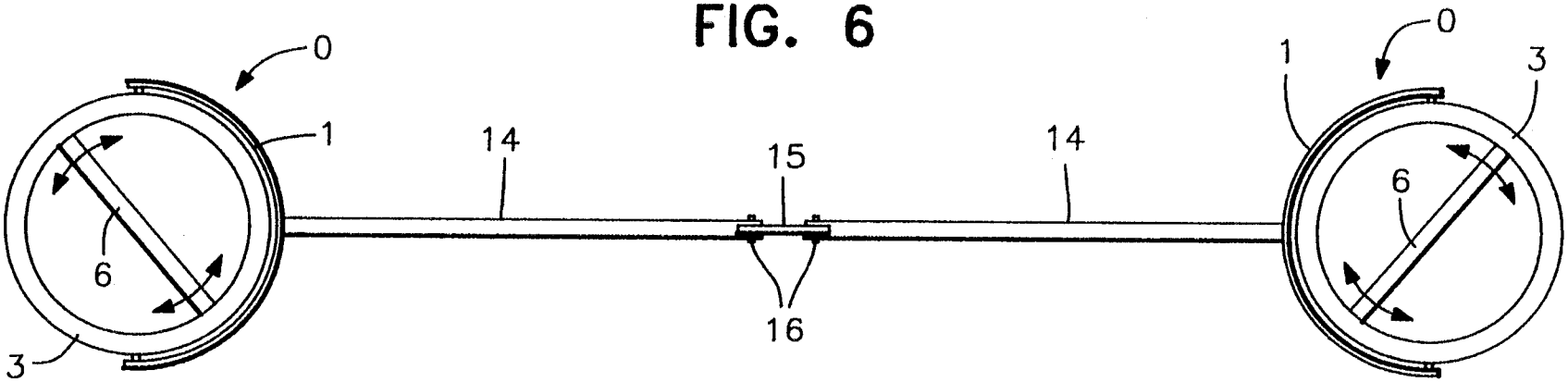
Figure 6A:
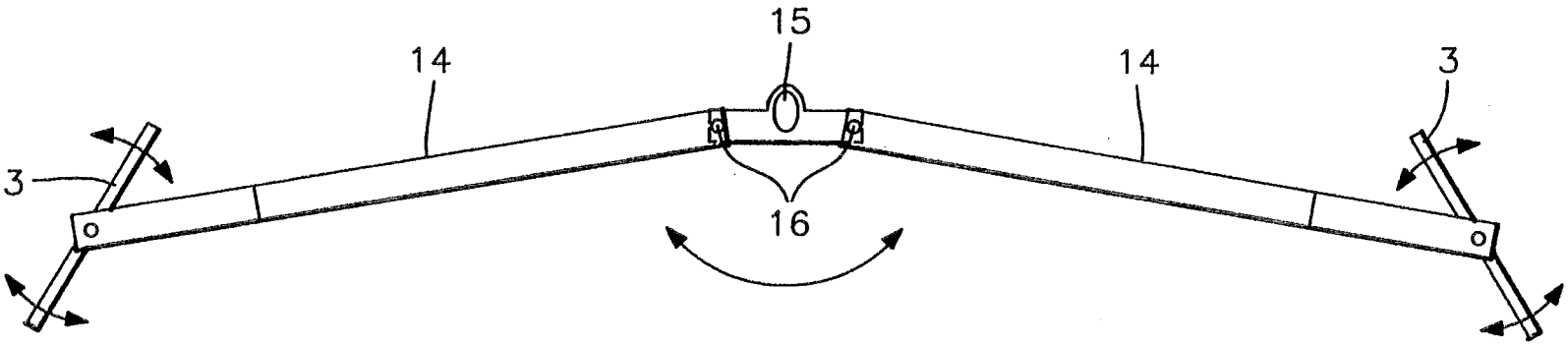

In the example of FIGS. 6*a* and 6*b*, being a frontal and elevational views, the grip handle assemblies are designated by 0 and are interconnected by two rods 14 which in turn are interconnected by means of joint 15 which enables a certain flexibility of the two parts.

It can easily be understood that while gripping bars 6 of the handle assembly 0 and performing various movements, such movements will be facilitated by the ability of the hoop 3 to turn about the axis between pins 2 and the handle to assume any diametrical position within the hoop 3.

I claim:

1. A grip handle for use with sport and athletic implements, said grip handle means for allowing said grip handle to rotate in two planes permitting freedom of movement in any desired direction and to any desired angle, said means comprising a closed hoop member pivotally mounted within the confines of a bow-shaped element for rotation about a diametric axis of said hoop member fixed relative to said bow-shaped element, and an elongated diametric grip rod mounted within said hoop member for continuous angular displacement relative thereto about an axis normal to the grip rod, passing laterally through the longitudinal center of said grip rod and fixedly disposed normal to the plane of the hoop member.

2. The grip handle of claim 1 wherein the opposite ends of said diametric grip rod are bifurcated and slidably straddle diametrically opposite portions of said hoop member.

3. The grip handle of claim 1 wherein the opposite ends of said diametric grip rod are bifurcated and form a fork with curved tines which slidably embrace the profile of the hoop member.

4. The grip handle of claim 1 wherein the opposite ends of said bow-shaped member include inwardly directed pins rotatably received in diametrically opposite outer peripheral portions of said hoop.

* * * * *